US010562146B2

(12) United States Patent
Mullany et al.

(10) Patent No.: US 10,562,146 B2
(45) Date of Patent: Feb. 18, 2020

(54) FIBER BASED FINISHING TOOLS

(71) Applicants: Brigid Ann Mullany, Charlotte, NC (US); Hossein Shahinian, Charlotte, NC (US)

(72) Inventors: Brigid Ann Mullany, Charlotte, NC (US); Hossein Shahinian, Charlotte, NC (US)

(73) Assignee: The University Of North Carolina At Charlotte, Charlotte, NC (US)

( * ) Notice: Subject to any disclaimer, the term of this patent is extended or adjusted under 35 U.S.C. 154(b) by 37 days.

(21) Appl. No.: 15/723,372

(22) Filed: Oct. 3, 2017

(65) Prior Publication Data

US 2018/0154495 A1 Jun. 7, 2018

Related U.S. Application Data

(60) Provisional application No. 62/430,103, filed on Dec. 5, 2016.

(51) Int. Cl.

| | |
|---|---|
| ***B24B 13/06*** | (2006.01) |
| ***B24B 29/00*** | (2006.01) |
| ***B24B 1/00*** | (2006.01) |
| ***B24B 19/14*** | (2006.01) |
| ***B24D 13/10*** | (2006.01) |
| ***B24B 19/26*** | (2006.01) |
| ***B24D 13/14*** | (2006.01) |

(52) U.S. Cl.

CPC ..... *B24B 29/005* (2013.01); *B24B 1/00* (2013.01); *B24B 19/14* (2013.01); *B24B 19/26* (2013.01); *B24D 13/10* (2013.01); *B24D 13/145* (2013.01)

(58) Field of Classification Search

CPC ..... B24D 13/06; B24D 13/10
USPC ..... 451/526, 539, 41, 42, 463, 464, 465, 59
See application file for complete search history.

(56) References Cited

U.S. PATENT DOCUMENTS

| | | | | |
|---|---|---|---|---|
| 3,871,139 A * | 3/1975 | Rands | B24B 39/006 | 15/104.066 |
| 4,646,479 A * | 3/1987 | Walker | B24B 9/00 | 451/124 |
| 4,835,913 A * | 6/1989 | Blanton | B24B 9/00 | 451/468 |
| 5,915,436 A * | 6/1999 | Johnson | A46B 3/005 | 15/187 |

* cited by examiner

*Primary Examiner* — Robert A Rose
(74) *Attorney, Agent, or Firm* — Clements Bernard Walker; Christopher L. Bernard

(57) ABSTRACT

A finishing tool for modifying a surface of a part, including: a base, wherein the base is one or more of rotated and translated; and one or more fibers coupled to the base; wherein a base portion of each of the one or more fibers is disposed at a first angle relative to a major axis of the base, wherein the first angle is equal to or between −90 degrees and 90 degrees; and wherein, in operation, an end portion of each of the one or more fibers is disposed at a second angle relative to the major axis of the base, wherein the second angle is approximately −90 degrees or 90 degrees, substantially parallel to the surface of the part. In operation, the base portion and the end portion of each of the one or more fibers is coupled by a continuously curved intermediate portion.

22 Claims, 4 Drawing Sheets

FIBER BASED FINISHING TOOLS

CROSS-REFERENCE TO RELATED APPLICATION

The present patent application/patent claims the benefit of priority of co-pending U.S. Provisional Patent Application No. 62/430,103, filed on Dec. 7, 2016, and entitled "FIBER BASED FINISHING TOOLS," the contents of which are incorporated in full by reference herein.

STATEMENT OF GOVERNMENT SUPPORT

The present invention was made with Government support under Award No. IIP-1338877 and IIP-1338898 awarded by the National Science Foundation (NSF). Accordingly, the Government has certain rights in the present invention.

FIELD OF THE INVENTION

The present invention relates generally to manufacturing machinery and processes. More specifically, the present invention relates to fiber based finishing tools designed to achieve smoother, isotropic finishes on parts. Manufacturers fabricating complex and freeform surfaces can use these fiber based finishing tools to manufacture optics (e.g. lenses and reflectors), biomedical devices (e.g. orthopedic implants), energy devices (e.g. turbine blades), and the like.

BACKGROUND OF THE INVENTION

Conventional polishing and lapping tool materials (i.e. polymeric pads, felt pads, cloths, metals, rubbers, and pitches) can only conform to planar, spherical, and mildly aspherical/freeform surfaces, resulting in unacceptable Mid-Spatial Frequency (MSF) range errors for complex and freeform surfaces. If such conventional tool materials are capable of removing material from higher topographical features, they will typically contact lower topographical features, damaging a part and resulting in an undesirable part finish. If such conventional tool materials are sufficiently stiff on a local scale, they are not sufficiently compliant on a global scale to conform to planar, spherical, and mildly aspherical/freeform surfaces.

Thus what is still needed in the art are improved finishing tools, such as the fiber based finishing tools of the present invention.

BRIEF SUMMARY OF THE INVENTION

In various exemplary embodiments, the present invention provides fiber based finishing tools for removing material from a part, such as a ceramic, a glass, a metal, a plastic, a composite, or the like. The fiber based finishing tools include a plurality of fibers that are arranged about and protrude from a rotating and/or translating base. These fibers can be disposed, at least in part, parallel or at an angle to a major shaft and/or axis of the finishing tool. These finishing tools are superior to conventional polishing and lapping tool materials (i.e. polymeric pads, felt pads, cloths, metals, rubbers, and pitches) that can only conform to planar, spherical, and mildly aspherical/freeform surfaces, resulting in unacceptable MSF range errors for complex and freeform surfaces. If such conventional tool materials are capable of removing material from higher regions of localized topographical features, they will typically also contact lower regions, thus not reducing the differential between higher regions and lower regions. If such conventional tool materials are sufficiently stiff on a local scale, they are not sufficiently compliant on a global scale to conform to planar, spherical, and mildly aspherical/freeform surfaces. The fibers of the present invention typically have a length on the scale of 5 mm or greater (20 mm-40 mm, for example) for MSF reduction and can have uniform or non-uniform cross-sectional geometries along the fiber length, such as a circular, triangular, square, or rectangular geometry or the like. This geometry directly affects fibers stiffness (and, conversely, compliance). The key aspect of the fibers of the present invention is that, on a fiber length scale, they have the ability to conform to variations in the surface curvature of a workpiece, e.g. freeforms and aspheres, while on a mid-spatial length scale (~0.05-3 mm) (i.e. in the MSF domain in the optics community), they do not deform between adjacent features (depending on fiber material and load selection, for example). The fibers only contact the apices of the MSF features, removing material preferentially from the high points, thereby reducing the magnitude of the MSF features. This has advantageous application in the optical and non-optical fields (e.g. the finishing of metallic turbine blades and the like), where there are tight tolerances on the required surface finishes.

In one exemplary embodiment, the present invention provides a finishing tool for modifying a surface of a part, comprising: a base, wherein the base is one or more of rotated and translated; and a plurality of fibers coupled to the base; wherein a base portion of each of the plurality of fibers is disposed at a first angle relative to a major axis of the base, wherein the first angle is equal to or between −90 degrees and 90 degrees; and wherein, in operation, an end portion of each of the plurality of fibers is disposed at a second angle relative to the major axis of the base, wherein the second angle is approximately −90 degrees or 90 degrees, substantially parallel to the surface of the part. Optionally, the major axis corresponds to a tool shaft. Optionally, the plurality of fibers are disposed circumferentially about one or more of a bottom surface and a side surface of the base. Each of the plurality of fibers has a length of greater that about 5 mm and a cross-sectional diameter or thickness along its length of greater than about 100 microns. Optionally, each of the plurality of fibers has a varying cross-sectional diameter or thickness along its length. Optionally, each of the plurality of fibers has a varying cross-sectional shape along its length. Optionally, each of the plurality of fibers has a varying composition along its length. In operation, the base portion and the end portion of each of the plurality of fibers is coupled by a continuously curved intermediate portion. Optionally, the tool further comprises a weighted structure coupled to an end of each of the plurality of fibers, wherein the weighted structure has a diameter or thickness that is greater than the diameter or thickness of the associated fiber. Optionally, the tool still further comprises an abrasive disposed about the plurality of fibers adjacent to the surface of the part, in the form of either an abrasive coupled to the fibers or an abrasive slurry between the fibers and the surface.

In another exemplary embodiment, the present invention provides a method for modifying a surface of a part, comprising: providing a finishing tool, comprising: a base, wherein the base is one or more of rotated and translated; and a plurality of fibers coupled to the base; wherein a base portion of each of the plurality of fibers is disposed at a first angle relative to a major axis of the base, wherein the first angle is equal to or between −90 degrees and 90 degrees; and wherein, in operation, an end portion of each of the plurality of fibers is disposed at a second angle relative to the major axis of the base, wherein the second angle is approximately −90 degrees or 90 degrees, substantially parallel to the surface of the part; and contacting the end portion of each of the plurality of fibers with the surface of the part. Optionally, the major axis corresponds to a tool shaft. Optionally, the plurality of fibers are disposed circumferentially about one or more of a bottom surface and a side surface of the base. Each of the plurality of fibers has a length of greater than about 5 mm and a cross-sectional diameter or thickness along its length of greater than about 100 microns. Optionally, each of the plurality of fibers has a varying cross-sectional diameter or thickness along its length. Optionally, each of the plurality of fibers has a varying cross-sectional shape along its length. Optionally, each of the plurality of fibers has a varying composition along its length. In operation, the base portion and the end portion of each of the plurality of fibers is coupled by a continuously curved intermediate portion. Optionally, the tool further comprises a weighted structure coupled to an end of each of the plurality of fibers, wherein the weighted structure has a diameter or thickness that is greater than the diameter or thickness of the associated fiber. Optionally, the tool still further comprises an abrasive disposed about the plurality of fibers adjacent to the surface of the part, in the form of either an abrasive coupled to the fibers or an abrasive slurry between the fibers and the surface.

BRIEF DESCRIPTION OF THE DRAWINGS

The present invention is illustrated and described herein with reference to the various drawings, in which like reference numbers are used to denote like tool components/method steps, as appropriate, and in which.

DETAILED DESCRIPTION OF THE INVENTION

Again, in various exemplary embodiments, the present invention provides fiber based finishing tools for removing material from a part, such as a ceramic, a glass, a metal, a plastic, a composite, or the like. The fiber based finishing tools include a plurality of fibers that are arranged about and protrude from a rotating and/or translating base. These fibers can be disposed, at least in part, parallel or at an angle to a major shaft and/or axis of the finishing tool. The fibers have a local stiffness that is sufficient to prevent them from conforming to local topography variations, such as MSF errors resulting from sub-aperture tooling processes. Thus, they preferentially remove material from higher local topography variations resulting in a reduction in MSF errors. These finishing tools are superior in MSF reduction as compared to conventional polishing and lapping tool materials (i.e. polymeric pads, felt pads, cloths, metals, rubbers, and pitches) that can only provide MSF reduction on planar, spherical, and mildly aspherical/freeform surfaces. If such conventional tool materials are sufficiently stiff on a local scale, they are not sufficiently compliant on a global scale to conform to planar, spherical, and mildly aspherical/freeform surfaces. The fibers of the present invention typically have a length on the scale of about 5 mm or greater and can have uniform or non-uniform cross-sectional geometries along the fiber length, such as a circular, triangular, square, or rectangular geometry or the like. This geometry directly affects fibers stiffness (and, conversely, compliance). Fiber stiffness (i.e. modulus) is of critical importance and balances local material removal capability with global conformal capability. The finishing tools of the present invention exhibit good wear resistance and thus enable advantageous processing times. The finishing tools are ideally suitable for Computer Numerical-Control (CNC) applications. Again, the key aspect of the fibers of the present invention is that, on a fiber length scale, they have the ability to conform to variations in the surface curvature of a workpiece, e.g. freeforms and aspheres, while on a mid-spatial length scale (~0.5-3 mm) (i.e. in the MSF domain in the optics community), they do not deform between adjacent features (depending on material and load selection, for example). The fibers only contact the apices of the MSF features, removing material preferentially from the high points, thereby reducing the magnitude of the MSF features. This has advantageous application in the optical and non-optical fields (e.g. the finishing of metallic turbine blades and the like), where there are tight tolerances on the required surface finishes.

Figure 1:
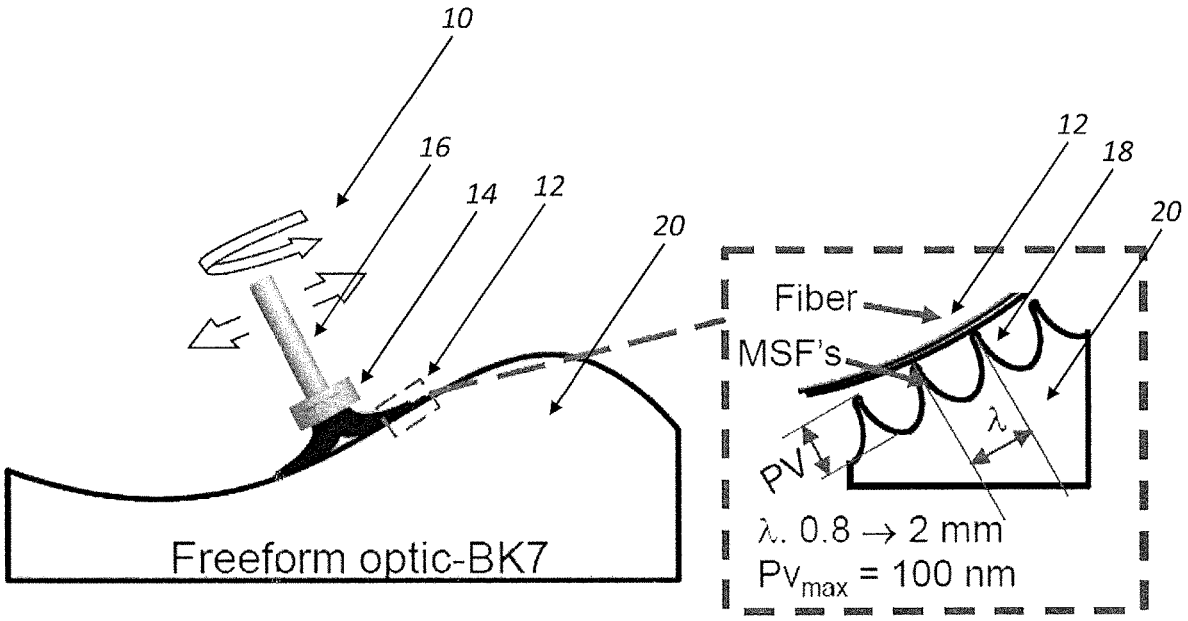
FIG. 1 is a schematic diagram illustrating one exemplary embodiment of the fiber based finishing tool of the present invention.

Referring now specifically to FIG. 1, in one exemplary embodiment, the fiber based finishing tool 10 of the present invention includes a plurality of fibers 12 coupled to a rotating and/or translating base 14. The fibers 12 can be arranged circumferentially about the bottom, top, or side surface of the base 14, or they can be arranged in another ordered or random pattern, as dictated by the given application. Preferably, the base 14 rotates and/or vibrates at a speed of about 100 rpm to about 1000 rpm (or higher). The base portion of each of the fibers 12 is disposed either parallel or at an angle to a major axis and/or shaft 16 of the finishing tool 10. The end portion of each of the fibers 12 is disposed either parallel or at an angle to the major axis and/or shaft 16 of the finishing tool 10 before the base 14 is actuated, but is disposed substantially perpendicular to the major axis and/or shaft 16 of the finishing tool 10 after the base 14 is actuated, substantially parallel to the MSF structures 18 of the part 20 such that the MSF structures 18 can be removed by the fibers 12. In most exemplary embodiments, in operation, the base portion and the end portion of each of the fibers 12 is coupled by a continuously curved intermediate portion. In this exemplary embodiment, each of the fibers 12 has a length on the scale of 5 mm or greater to accommodate any MSF depth, with any given MSF spacing. Each of the fibers 12 has a cross-sectional diameter or thickness along its length of greater than about 100 microns. Each of the fibers 12 has a uniform or non-uniform cross-sectional geometry along the fiber length, such as a circular, triangular, square, or rectangular geometry or the like. This geometry directly affects fiber stiffness (and, conversely, compliance). Again, fiber stiffness (i.e. modulus) is of critical importance and balances local material removal capability with global conformal capability. In this exemplary embodiment, one or more fibers are coupled to the base 14. It should also be noted that the fiber material can vary from base to tip, thereby providing a graduated stiffness/compliance. The cross-sectional diameter or width of the fiber 12 can also vary from base to tip, creating a tapering or widening fiber 12.

Figure 2:
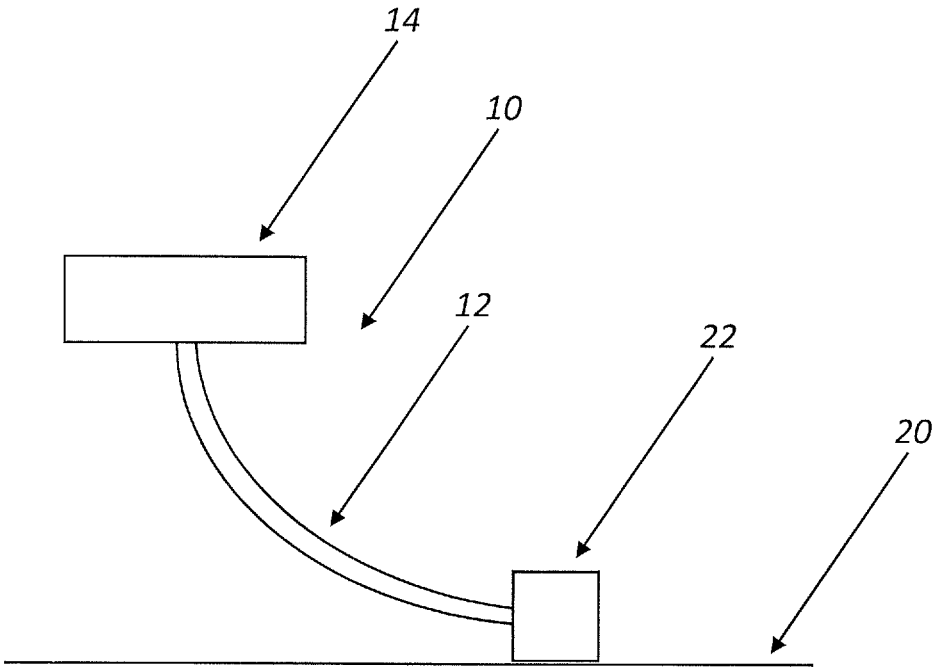
FIG. 2 is a schematic diagram illustrating another exemplary embodiment of the fiber based finishing tool of the present invention.

Referring now specifically to FIG. 2, in another exemplary embodiment, the end of each of the fibers 12 is equipped with a weighted structure 22, resembling a dumbell end. This weighted structure 22 can be a separate component, or it may be integrally formed with the end of the fiber 12. The fiber 12 applies a load to the weighted structure 22, which, due to its larger cross-sectional area, has greater local stiffness than the fiber 12, thereby providing reduced deflection across the MSF structure 18 (FIG. 1). Accordingly, longer MSF structures 18 can be reduced and polished. In this exemplary embodiment, the diameter or thickness of the fiber 12 is on the order of 1 mm, while the diameter or thickness of the weighted structure 22 is on the order of 5 mm, although other dimensions are feasible.

The fibers 12 used in all embodiments can be natural (i.e. hydrophilic) or synthetic (i.e. hydrophobic). The fibers 12 can be operated in an abrasive slurry that is contacted by and/or adheres to the fibers, thereby inducing material removal. It is believed that smaller abrasive particles promote preferential MSF removal.

As described above, large polymeric pad and pitch based tools utilized in full aperture polishing processes where the tool is larger than the workpiece, have been successfully downsized to operate in CNC environments to smoothen and deterministically finish a range of workpiece materials and geometries. The smaller tools, typically less than 1/10th the diameter of the optic finished (referred to as sub-aperture tools), are rastered over the workpiece surface by a multi-axis machine tool or robot, removing material in a controlled manner. Operating with this tool-workpiece configuration is referred to as computer controlled polishing (CCP), and is among one of the key enabling processes in the manufacture of precision freeform optics, for example. The general structure of sub-aperture sized tools is similar to full aperture tools, where the polishing pad or pitch layer is adhered to a rigid metal substrate. This tool structure can restrict the application of the tool to finishing surfaces with zero to low variations in surface curvature, i.e. planar, spherical, or weakly aspherical surfaces. The addition of a compliant layer between the substrate and the pad can provide sufficient tooling flexibility to accommodate some surface slope variations. However, there are limitations to this approach. While adaptive tooling (i.e. the shape of the tool is pneumatically controlled) has been developed for larger sub-aperture tools (e.g. diameter≈1 m) used in the finishing of very large workpieces (e.g. several meters in diameter), few developments have been made, or novel approaches considered, for smaller, centimeter sized tools. Although not intended to be limiting, polymeric fibers are of interest as they are inherently compliant on a global scale, and thus are capable of accommodating workpiece surface curvature changes, while also maintaining contact with the surface to promote material removal. As with conventional polishing tool materials, an abrasive polishing slurry can be used to remove material.

By way of helpful background, material removal in glass polishing is a complex combination of chemical and mechanical interactions between the tool, slurry, and workpiece surface. Slurry chemistry modifies the workpiece surface, facilitating its removal by the abrasive particles contained within the slurry. The polishing tool interacts with the abrasives and ensures that they engage with the workpiece surface to remove material. With pad based tools, the abrasives become embedded and/or entrained in the pad's topmost surface, making them available to interact with the workpiece in a number of different ways; either plough across the surface (if securely embedded within the tool surface), roll across the workpiece (if not so securely embedded within the tool surface), or impact the surface if only entrained in the tool surface (i.e. a pocket of slurry in a pad's surface topography). The interaction mechanism will affect the removal rate. The topography of the pad, as well as its elasticity, will affect the nature of the abrasive-workpiece contact mode and the magnitude of the load transferred from the abrasive to the workpiece. While sophisticated models exist incorporating both pad topography and properties, and details of the abrasive used, they are all fundamentally based on Preston's equation. This empirically based equation, first reported in 1927, correlates the material removal rate, MRR, to the applied pressure, P, and the relative velocity, V, between the tool and the workpiece:

$$MRR=K_pPV \quad (1)$$

The $k_p$ term, called Preston's coefficient, accommodates all other process influences, such as pad type, abrasive size, type and concentration, process temperatures, etc. The simplicity of this equation and its ability to provide reasonable insights into pad based polishing processes have made it the initial starting point for most polishing process analyses.

Replacing conventional polishing tools with fiber-based tools will most certainly alter the nature of the abrasive-workpiece interaction. When using cylindrical fibers, only a very small region of the fiber will be in contact with the workpiece surface, thus limiting the number of abrasives embedded in the fiber (if any) available to interact with the surface. However, the fibers have the potential to entrain abrasives in their leading edge and push them across the surface in a manner similar to a wiper blade pushing water across a surface. This action is expected to contribute significantly to material removal. In addition to the actual contact length between the fiber and the workpiece, the minimum gap permitted between the fiber and the workpiece to effectively entrain particles should also be considered. It is expected that this total effective contact length, which includes the length of fiber in actual contact with the workpiece and the length of fiber on either side that can entrain abrasives, will vary with abrasive particle size for any one fiber type and set of processing conditions. The fiber is also expected to apply a downward load on the abrasive, further promoting material removal.

The fiber based tool is similar to a flat ended paint brush, so that when engaged with the workpiece, the fibers fan out, providing an annular working contact region. Although fiber-based tools are commercially available, i.e. for painting and deburring applications, it is challenging to obtain a range of tools containing fibers of known material and varied configurations, i.e. fiber diameters and number of fibers per tool, etc., to facilitate a systematic investigation of their polishing capability. To overcome this obstacle, a selection of exemplary polymeric based fibers were sourced and their potential to be both used and fashioned into an effective polishing tool evaluated. It will be readily apparent to those of ordinary skill in the art that the use of polymeric based fibers is not strictly required. Criteria for fiber selection included: 1) ability to apply a load to the workpiece, 2) sufficiently compliant to ensure fiber-workpiece contact lengths on the order of 5 mm or greater for MSF reduction, and 3) ease of handling to facilitate the manual fabrication of the tools. Fiber material modulus and diameter directly affect all the three criteria, with overall fiber compliance, C, being related to these parameters as given below:

$$C \approx 1/EI \quad (2)$$

where E is the Young's modulus of the fiber material and I is the second moment of the cross-sectional area of the fiber ($I=\pi r^4/4$, where r is the fiber radius). For ease of handling, and considering that the ability of the fiber to exert a load on the workpiece decreases with decreasing fiber diameter (pressure≈1/C), fibers with diameters less than 200 micron were not considered, although they could be used. Table 1 below provides details of the fibers selected for initial testing. As difficulties still arose in obtaining fibers where the exact material properties were known, estimates of the material properties were extracted from literature.

TABLE 1

Details of the fibers selected for initial testing.

| Material | Fiber Ø (mm) | Fiber length (mm) | Estimated Modulus (GPa) |
|---|---|---|---|
| Nylon 6/6 | 1.6 | 37 | 2.2 [19] |
| Copolymer | 1.4 | 37 | 2.8 [20] |
| Copolymer | 0.5 | 37 | 2.8 [20] |
| Silicone | 1.3 | 37 | 0.001 [21] |

To evaluate the potential of each fiber, a simple test setup consisting of a vertical stage and a precision scale was utilized. A single fiber is attached to the micrometer screw driven z-stage. The stage is lowered, and the load exerted by the fiber as it engages with the scale surface is noted. An Ohaus Adventurer Pro scale with 0.1 mg resolution is used. A ruler placed behind the fiber to allow for a visual estimation of the length of fiber that engages with the scale's surface. Backlighting was used when necessary to assist in estimating the contact lengths. While this method does not provide any insights on the pressure distribution along the fiber length, it is still a useful initial evaluation approach. The expected pressure distributions are discussed in the following computational analysis section herein.

TABLE 2

Results from single fiber evaluations.

| Fiber | Load (N) | Observed contact length (mm) | Estimated pressure (kPa) |
|---|---|---|---|
| Fiber at 90° - FIG. 4(a) | | | |
| Nylon 6/6 | 0.53 | 5.8 | 600 |
| Copolymer (Ø 1.4) | 0.75 | 4.5 | 1016 |
| Copolymer (Ø 0.5) | 0.01 | 6.75 | 31 |
| Silicone | 0.03 | 25 | 1.4 |
| Fiber at 40° - FIG. 4(b) | | | |
| Nylon 6/6 | 0.32 | 7 | 300 |

Table 2 details the loads applied by the different fibers and their observed contact lengths. In the last column of Table 2, an estimate of the pressure applied by each fiber is provided. This is calculated by simply dividing the load by an estimate of the contact area (contact length×contact width), whereby the contact width is estimated at 100 μm. The estimated pressures are much higher than typical polishing pressures, which are on the order of 20 to 100 kPa. In order to reduce the pressure while maintaining an equivalent contact area, the orientation of the fiber to the surface was changed. Using the same testbed, it was found that orienting the Nylon 6/6 fiber 40° to the surface normal, instead of at 90°, reduced the polishing pressure to 300 kPa while maintaining a comparable contact length. As stated earlier, there is a preference for fibers capable of both applying a sufficient load and maintaining a favorable contact length (>5 mm). Based on these criteria, the Nylon 6/6 fibers were chosen for the fiber based tools.

Two different tools were created with Nylon 6/6 fibers (sourced from Hahl-Pedex: Hahl PA 6/6). In the initial configuration (designated 90°_N66), thirteen fibers were arranged circumferentially on the tool shank (carbon steel) at a radius of 6 mm. In the second configuration (designated 40°_N66), twelve holes for the fibers were CNC drilled at an angle of forty degrees to the tool axis at a radius of 2 mm. Fibers were secured in place using cyanoacrylate glue. Tools 90°_N66 and 40°_N66 apply polishing loads on the order of 4.7 N and 3.4 N, respectively.

An initial test to evaluate the long term stability of the 90°_N66 tool was conducted. The tool was loaded onto a Bridgeport milling machine. A water bath, containing a float glass sample, was placed on an Ohaus Navigator XT scale (0.5 g measurement resolution, 10 Hz sampling rate) which is secured onto the bed of the machine tool. The tool is maneuvered over the water bath and then brought into contact with the glass sample (i.e. until a load is registered on the scale). The tool is then further lowered towards the sample, where the magnitude of the z direction translation is close to that implemented in the single fiber test-setup. The spindle is turned on and rotates the tool at 100 rpm. The load (measured mass×9.81 m/s2) is continuously recorded at 10 Hz for the duration of the test. Two different tests were performed. In the first test, a newly fabricated 90°_N66 tool was left running for 4 hours. In the second test, performed on a different day, the 90°_N66 tool was run for 9 hours. Exponential fits to the two load curves reveal little difference between them. The exponential drop in load can be attributed to mechanical creep of the fibers. Extensive study on the creep behavior of polymers exists in the literature, and references have shown an exponential relation between stress and strain in a sustained load configuration. While these tests were done in the absence of abrasives, optical microscopy analysis of the fibers found no obvious evidence of fiber wear, i.e. the formation of wear flats or excessive scratching of the fibers. Repeatable load decay and little wear suggests these fiber based tools have the potential to operate for long periods of time.

By way of helpful modeling information, to better understand the distribution of the contact pressure between the fiber and the workpiece and to aid in the selection of the most suitable fibers for polishing, the interaction of a single fiber with the workpiece is studied using the finite element software ABAQUS/Standard. For the purposes of the present studies and based on the discussion in the previous section, the contact pressure and the size of the contact area are of primary interest. Therefore, only the initial phase of the polishing operation is considered, i.e. where the fiber establishes contact with the workpiece. No fiber creep or tool rotation is considered in the analyses. The glass workpiece is taken to be of dimensions 37.5 mm×5 mm×1 mm. The fiber is made of Nylon 6/6. The glass workpiece is assumed to behave only elastically (i.e. isotropically), whereas the fiber is treated as an elastoplastic material with nonlinear hardening. In the finite element model, the nonlinear behavior of the fiber is captured using a tabulated data of yield stress values for various plastic strains extracted from the stress-strain curve.

TABLE 3

| Mechanical properties of fiber and workpiece material | | |
|---|---|---|
| Material | Young's Modulus | Material behavior |
| Nylon 6/6 | 2.207 GPa | Elastoplastic with isotropic strain hardening |
| Glass | 70 GPa | Elastic |

The interaction between the fiber and tool is carried out in three steps. In step 1, the fiber alone is given a deformation consistent with the observed initial shapes of the fibers prior to polishing. This is followed by step 2, where the fiber and workpiece are brought into contact with each other. Once the contact is established, in step 3, the imposed end displacement of the fiber (from step 1) is relaxed and a vertical force is applied on the bottom of the workpiece to simulate the initial stages of the polishing process. The friction coefficient between the fiber and the workpiece is taken to be 0.1. The normal behavior of the fiber is chosen as "hard" contact, in which there is no contact when the contact pressure approaches zero. The constraint enforcement method for the pressure-overclosure is chosen as the direct method. The workpiece is the master surface, while the fiber serves as the slave surface. Finite sliding was opted for the sliding formulation, and the surface to surface discretization method was used in the meantime. Due to the symmetry of the geometry and contact about a vertical plane bisecting the fiber and the workpiece, only a half of the fiber and workpiece are considered in analyses. The fiber is fixed at the top, whereas the boundary conditions on the fiber and workpiece change with the step. The symmetric plane of the fiber and workpiece observe the symmetry boundary condition with respect to the vertical plane, while the top of the fiber is constrained with zero displacements in all directions. The bottom face is given an angular displacement as much as 120° around the y axis in steps 1 and 2. In step 3, this displacement is relaxed. The bottom face of the workpiece has zero displacement in step 1 and 20.5 mm and 22.5 mm in steps 2 and 3, respectively.

The C3D10M elements in ABAQUS (the modified quadratic tetrahedral elements) are used to discretize both the workpiece and fiber. Nonuniform mesh is used with the finely sized elements in the areas of high deformations. The results in the present work are for a very finely meshed model with a total of 327224 elements and 493155 nodes.

The most significant outcomes of the FE model applicable to the tools are the pressure distribution and actual and effective contact lengths between the fiber and the workpiece. Based on Preston's equation, polishing removal rates are directly correlated to the polishing pressures. Hence, the pressure distribution from the model should be reflective of experimentally obtained material removal profiles. Also, the width of the annular region where material removal is expected, should correlate to the effective contact length between the fiber and the workpiece. The effective contact length is defined as the region where the gap between the fiber and the workpiece is sufficiently small so as to entrain abrasive particles in the fiber's leading edge. As the slurry used in the majority of experimental work detailed in this paper contains particles up to 4 microns in diameter, the region where a gap of 4 microns or less exists between the fiber and the workpiece is defined as the effective fiber-workpiece contact length. The built in COPEN parameter can provide this information. Actual contact lengths between the fiber and workpiece are extracted using the CPRESS parameter. The mesh size has a strong influence on the COPEN and CPRESS parameters and, therefore, the mesh used must be fine enough to obtain accurate estimates of these parameters. Furthermore, as mentioned, the material properties of the fiber are taken from the open literature and there is some uncertainty in the Young's modulus of the fiber. Additional factors that have a direct influence on the COPEN and CPRESS parameters are the contact solution approach, the friction coefficient, and the possibility of inelastic deformation of the fibers during contact. To investigate the effect of all of the factors, a parametric study was carried out and the results are summarized in Table 4. As these results show, the inclusion of inelastic behavior had the largest impact on the model outcomes. This is not entirely surprising since the fibers undergo significant plastic deformation during the contact with the workpiece.

TABLE 4

| Sensitivity of the contact length (from CPRESS) and effective contact lengths (from COPEN) to different model inputs | | |
|---|---|---|
| Parameter | % Variation | Details/Range Tested |
| Modulus of Elasticity | Below 5% | From 1 to 6 GPa |
| Coefficient of Friction | Below 5% | From 0.01 to 0.5 |
| Contact Solution Method | Below 5% | Lagrange, direct, penalty |
| Meshing scheme | Below 5% | Tetrahedral vs hexahedral |
| Fiber Material | 25% | Elastic vs plastic |

With the sensitivity analysis finalized, pressure distributions of the fiber on the workpiece for both the tool configurations were obtained. The same v-shaped pressure profile is observed for both tools, with the 90°_N66 resulting in a higher maximum pressure. This agrees with the single fiber test results. Both the actual contact length and the effective contact length as determined from COPEN are larger for the 90°_N66 tool (10.7 mm vs 4.11 mm). This, combined with the higher pressure profiles, suggest that a higher material removal should be obtained with the 90°_N66 tool over the 40°_N66 tool.

The ability of fiber-based tools to remove material from BK7 glass samples was evaluated on the same test set-up used to evaluate the long term stability of the tools. No tool translation was included in the tests. In addition to testing the two different tool configurations, different process conditions (loads and spindle speeds) and slurries were evaluated to determine the validity of 1) applying Preston's equation to fiber-based tools and 2) the fiber-workpiece effective contact length concept. In the first four tests detailed in Table 5, a ceria-based slurry (HastilitePO®, 40%-50% solids) is used, by way of example only. According to the suppliers, 90% of the particles have a nominal diameter below 1 micron, while the remaining particles may be as large as 4 microns. This slurry is mixed with water at a ratio of 1 to 10 and during polishing with very obvious settling of particles on the workpiece surface observed, i.e. the particles fall out of the suspension, and additional agglomeration may occur. In test 5, a different ceria-based slurry is used (Eminess Ultra-Sol® Optiq, 45% solids). The nominal particle size is slightly smaller at 0.4 microns, and the slurry (also mixed with water using the same ratio) is designed so the particles remain in suspension, i.e. no settling of abrasives, or additional agglomeration is expected.

TABLE 5

| Testing conditions on BK7 glass samples. | | | | |
|---|---|---|---|---|
| Test No. | Tool (& no. of fibers) | Load (N) | Speed (rpm) | Time (min) |
| Hastilite PO ® Slurry | | | | |
| 1 | 90°_N66 (13) | 4.7 | 100 | 10 |
| 2 | 40°_N66 (12) | 3.4 | 100 | 10 |
| 3 | 90°_N66 (13) | 4.7 | 200 | 5 |
| 4 | 90°_N66 (13) | 7.8 | 100 | 5 |
| Ultra-Sol ® Optiq Slurry | | | | |
| 5 | 90°_N66 (13) | 4.6N | 100 | 10 |

Planar BK7 samples with a diameter of 75 mm were used in all tests. The planarity of the samples was measured using a Zygo Verifire AT1000 laser Fizeau interferometer. Within the working area of the samples (Ø≈70 mm), the deviation from a planar surface is less than 158 nm, i.e. λ/4, where λ=633 nm. The initial surface roughness of the samples was measured using a Zygo ZeGage scanning white light interferometer (SWLI) with a 20×411 objective. Initial $S_q$ surface finish values were on the order of 1.89 nm. Table 6 provides additional details regarding the measurements.

TABLE 6

| Measurement system details | |
|---|---|
| Form | |
| Zygo Verifire AT1000 | 6" aperture<br>Detector size: 1000 × 1000 |
| Processing & Filters | Removed tilt and piston |
| Roughness | |
| Zygo ZeGage | Objective: 20× Mirau<br>Detector size: 1024 × 1024<br>FOV: 417 μm × 417 μm<br>Resolution: 0.71 μm |
| Processing & Filters | $4^{th}$ order polynomial |

To determine the volume of material removed by the polishing process, the samples are first cleaned and then re-measured. The 'after polishing' interferogram is subtracted from the 'before polishing' measurement and the averaged radial profile for the tool's complete working zone (i.e. circular footprint) is determined. The negative height values are integrated to determine area of material removed for the profile. This is then rotated 360 degrees to provide a material removal volume value.

Material is clearly removed from an annular region corresponding to where the fibers are in contact with the workpiece surface. The volumetric material removal rate is on the order of 2×105 $\mu m^3/s$. To provide insights on how this MR compares to that achievable with a conventional pad based tool, a comparison was made with previously conducted polishing tests with a UNINAP-1™ pad and the same slurry. Using a Ø10 mm tool to polish fused silica, material removal rates on the order of 8×105 $\mu m^3/s$ were obtained. Despite the pad based tool system having lower associated pressures and relative velocities than the fiber based tool, it removed significantly more material. This is most likely related to the ability of the pad surface to entrain abrasives and the larger contact area available to interact with the workpiece surface. Relative velocities and applied pressures for the pad based tool were approximately 0.13 m/s and 190 kPa, while they are estimated at 0.26 m/s and 280 kPa for the fiber based tool. Estimated tool-workpiece contact areas are ~$7.9\times10^{-5}$ $m^2$ for the pad based tool versus ~$1.7\times10^{-5}$ $m^2$ for the fiber-based tool.

TABLE 7

| Profile comparison Experimental (Tests 1 and 2) Vs FEA | | |
|---|---|---|
| | 90°_N66 (Test 1) | 40°_N66 (Test 2) |
| Experimental | | |
| Vol removed per fiber/s ($\times10^5$ $\mu m^3/s$) | 0.15 | 0.13 |
| Processing width (mm) based on interferometer measurement | 14.34 | 9.1 |
| FE Model Predictions | | |
| Actual contact length (mm) based on pressure distribution data | 3.75 | 2.85 |
| Effective contact length (mm) based on COPEN ≤ 4 micron | 10.95 | 5.35 |

Table 7 reports the corresponding volume of material removed and the processing width (fiber-workpiece effective contact length) as estimated from the interferograms. For ease of comparison, the FE model predictions for the actual and effective fiber-workpiece contact lengths, as extracted from the pressure distribution data and COPEN, respectively, are also included. From an initial glance at the profiles and data in Table 7, it appears that while the FE model predictions and experimental results differ in magnitude, the expected removal profile and general trends agree. The v-shaped pressure distribution predicted by the FE model is reflected in the v-shaped material removal profiles obtained using both tool geometries. The 90°_N66 tool, which has higher associated pressure distributions and wider processing zones, removes more material across a wider region than the 40°_N66 tool.

Differences between the FE model predictions and those experimentally obtained can be attributed to the complex nature of the polishing process, which is influenced by a wide range of factors including, but not limited to, tool rotational speeds, process vibration levels, load transfer between the fibers and the abrasives, slurry hydrodynamics, and chemical interactions between the slurry, the abrasives, and the workpiece itself. Considering the above, the ability of this comparatively simple FE model to capture material removal profile shapes and relative differences is encouraging and demonstrates its potential to provide insights into the expected behavior of different tooling geometries.

As the load decay associated with the tools is consistent over long periods of time, it suggests material removal from test to test should also be consistent. To verify this, tests 1 and 2 were repeated three times and the resulting contact lengths and material removal rates evaluated. For test 1, the standard deviations of the volume of material removed per fiber and the measured processing width, expressed as a percentage of their averages, are 14.2% and 7.4%, respectively. Two of the data points for test 2 are very comparable, however one data point is significantly lower. The reason for the discrepancy is not known.

To determine if Preston's material removal equation can be applied to fiber-based tools, two additional tests with the 90°_N66 tool were performed; one with a higher load, and the other with a higher spindle speed (tests 3 and 4, Table 5). To facilitate comparison between tests 1 to 4 detailed in Table 4, the material removal rate ($\mu m^3/s$) per fiber is plotted against the applied load (N) times the averaged linear speed of the rotating fibers (2π×spindle speed×average radial distance), i.e. the key parameters in Preston's equation. For the data points obtained with the 90°_N66 tool, the data is as expected, higher loads and higher speeds yield higher removal rates. The data obtained with the 40°_N66 tool appears to fit the same trend. If a best fit line is fit through all the data points (excluding the 40°_N66 outlier), and the y-axis intercept set to zero (no pressure or velocity implies no material removal), the R2 value is 0.80, indicating a reasonable correlation between the applied loads, velocities, and the removal rate.

If the concept of the effective contact length between the fiber and the workpiece (outlined above) is valid, intuition suggests that decreasing the particle size will reduce the effective contact length. This is confirmed by comparing the processed region widths obtained from test 1 and test 5. While the particle size associated with the slurry used in test 5 is not much smaller than that in test 1, the slurry used in test 5 remains in suspension and is not believed to agglomerate as is suspected with slurry 1. The associated processing width, corresponding to effective contact length is significantly smaller. Other preliminary tests conducted with even smaller particles (<100 nm) also support the concept of an effective contact length, where smaller particles result in narrower process widths.

After 10 minutes of polishing with the 90°_N66 tool and HastilitePO®, the surface roughness was measured at numerous locations within the processed region. The surface finish on the unprocessed part is already of good quality, $S_q$1.89 nm (±0.08 nm), where the number in parenthesis is the standard deviation over 11 measurements. This quality is unsurprising as planar BK7 samples (flatness<λ/4) were purchased specifically for all tests, and were most likely fabricated by a full aperture pitch or pad polishing process. Post processing the surface finish was 3.66 nm (±2.21 552 nm). Some deterioration in the surface quality occurred, however considering the stationary nature of the spot test, and the high quality of the incoming surface, the extent of deterioration is not discouraging. In reality it would have been surprising if the surface was significantly better than that delivered by the supplier. The addition of tool translation, which will also promote additional slurry mixing and help prevent slurry agglomeration at fiber leading edges, is expected to further alleviate this concern.

As the fibers have the potential to operate for long periods of time, it is of interest to assess the extent of fiber wear occurring. Both used and unused Nylon 6/6 fibers were examined using the SWLI (20×). Some wear has occurred on the leading edge of the fiber during its 5.33 hours of operation, but it is not considered excessive. Further studies will be required to understand the wear rates and its impact on removal rates.

Thus, polymeric based fiber tools were fabricated and their ability to remove material from BK7 glass samples was evaluated. Initial results from spot tests indicate that within the given testing conditions, material removal can be predicted by Preston's equation, i.e. higher loads and relative velocities produce higher material removal. While not explicitly discussed, the results indicate that the material removal will also increase with an increasing number of fibers used in the tool. A new metric specific to fiber tools, termed the effective contact length, captures a key fiber-based material removal mechanism. This metric describes the length of fiber that is capable of entraining particles along its leading edge and pushing them across the workpiece's surface to effectively remove material. It is proposed that the magnitude of the effective length is the combination of the length of the fiber in physical contact with the workpiece along with the length of the fiber where the gap between the fiber and the workpiece is too small to let abrasive particles pass beneath unhindered. As shown in this work, the effective contact length will vary with particle size where smaller particles result in shorter effective contact lengths. Fiber geometry and material properties affecting its overall compliance are also expected to influence the effective contact length. The surfaces processed by the fiber-based tools had finishes ranging from 3 nm to 7 nm $S_q$ (SWLI 20×), a deterioration of the initial ingoing surfaces of 2 nm $S_q$. The final roughness values are expected to improve when tool translation is incorporated. The fiber-based tools do not appear to exhibit excessive wear over long periods of time (>5 hrs), and while their applied load decays with time, it does not decay to zero (in the 9 hour testing window) and the rate of decay appears to be consistent. Both of these attributes are favorable for long term, unsupervised operation, i.e. in CNC environments. An FE model of a single fiber engaged with the workpiece surface was generated in parallel. Although the model does not include tool rotation or creep, the predicted v-shaped pressure distributions exerted by the fiber on the workpiece reflect the measured v-shaped material removal profiles obtained in the polishing tests. This further supports the application of Preston's equation to fiber based polishing. Two different fiber-workpiece orientations were modelled to match the two different tool configurations tested. The general trends predicted by the FE model agree with the experimental findings. The FE predicted pressure distribution width and magnitude are higher for the 90°_N66 tool than the 40°_N66 tool, reflecting that the 90°_N66 tool removes more material than the 40°_N66 tool. The effective contact length concept can be captured in the FE model through the use of the COPEN parameter. These findings highlight the usefulness of FEM in predicting tooling characteristics and assisting in future tool design.

Figure 3:
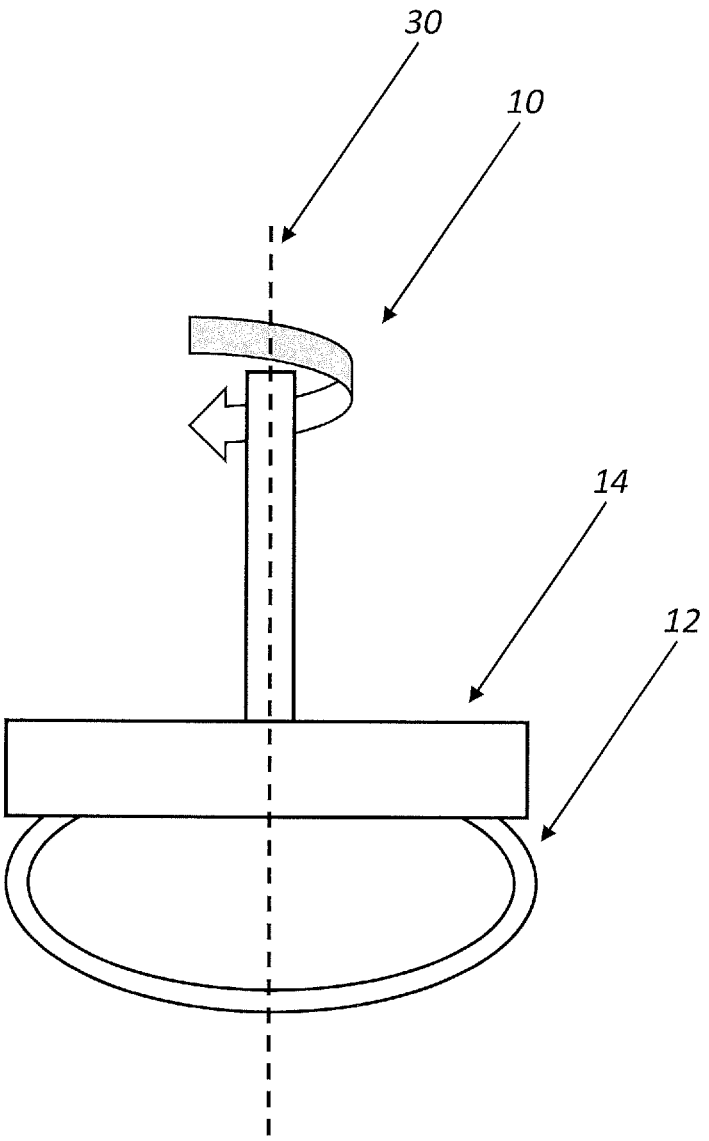
FIG. 3 is a schematic diagram illustrating a further exemplary embodiment of the fiber based finishing tool of the present invention.
Figure 4:
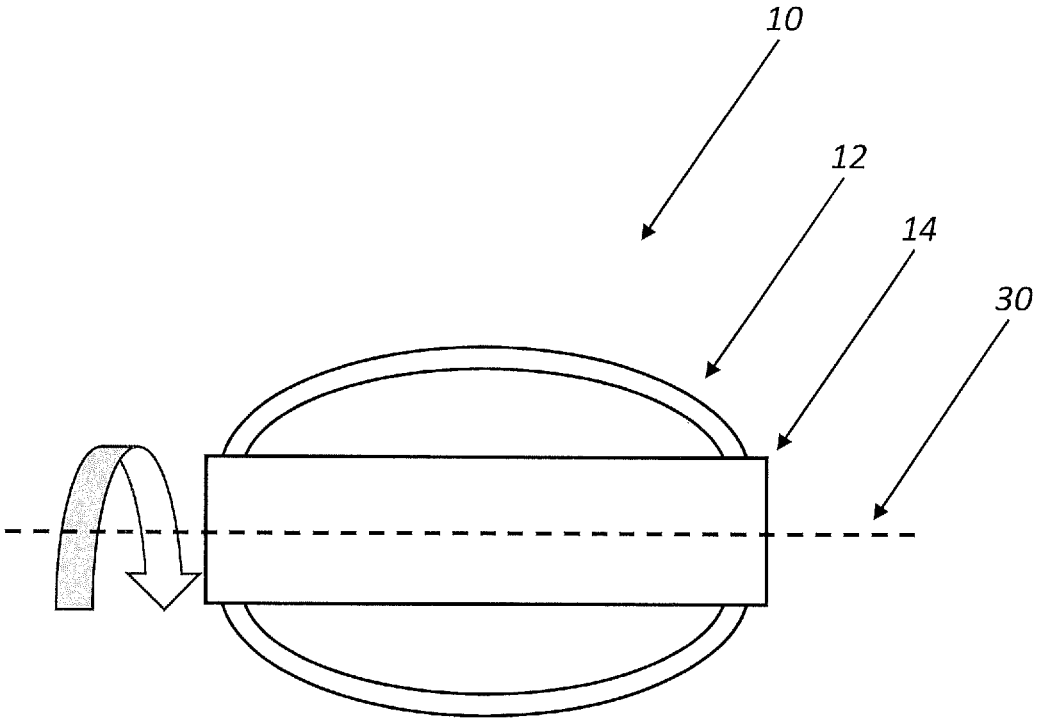
FIG. 4 is a schematic diagram illustrating a still further exemplary embodiment of the fiber based finishing tool of the present invention.

Referring now specifically to FIGS. 3 and 4, in two alternative embodiments, the fiber based finishing tool 10 of the present invention again includes a plurality of fibers 12 coupled to a rotating base 14. In these alternative embodiments, both ends of the fibers 12 are coupled to the rotating base 14, such that fiber loops are formed. Preferably, the base 14 rotates at a speed of about 100 rpm to about 1000 rpm (or higher). The middle portion of each of the fibers 12 is disposed either parallel or at a low angle to the MSF structures 18 (FIG. 1) of the part 20 (FIG. 1) when the rotating base 14 is actuated, such that the MSF structures 18 can be removed by the fibers 12. Each of the fibers 12 has a length on the scale of 5 mm or greater to accommodate any MSF depth, with any given MSF spacing. Each of the fibers 12 has a cross-sectional diameter or thickness along its length of greater than about 100 microns. Each of the fibers 12 has a uniform or non-uniform cross-sectional geometry along the fiber length, such as a circular, triangular, square, or rectangular geometry or the like. This geometry directly affects fiber stiffness (and, conversely, compliance). Again, fiber stiffness (i.e. modulus) is of critical importance and balances local material removal capability with global conformal capability. In this exemplary embodiment, one or more fibers are coupled to the base 14. It should also be noted that the fiber material can vary from base to tip, thereby providing a graduated stiffness/compliance. The cross-sectional diameter or width of the fiber 12 can also vary from base to tip, creating a tapering or widening fiber 12. The difference between FIG. 3 and FIG. 4 lies in the position and orientation of the rotational axis 30.

Although the present invention is illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the present invention, are contemplated thereby, and are intended to be covered by the following non-limiting claims.

What is claimed is:

1. A finishing tool for modifying a surface of a part, comprising:

a base, wherein the base is one or more of rotated and translated; and one or more fibers coupled to the base;

wherein a base portion of each of the one or more fibers is disposed at a first angle relative to a major axis of the base, wherein the first angle is equal to or between −90 degrees and 90 degrees;

wherein each of the one or more fibers has a sufficient flexibility such that, in operation, an end portion of each of the one or more fibers is disposed at a second angle relative to the major axis of the base, wherein the second angle is approximately −90 degrees or 90 degrees, substantially parallel to the surface of the part;

wherein each of the one or more fibers has a sufficient rigidity such that, when the end portion of each of the one or more fibers is disposed substantially parallel to the surface of the part in operation, the end portion of each of the one or more fibers removes only a relatively higher topographical feature of a Mid-Spatial Frequency (MSF) structure and is suspended above a relatively lower topographical feature of the MSF structure; and wherein the end portion of each of the one or more fibers disposed substantially parallel to the surface of the part contacts a plurality of MSF structure apices over a distance of at least 5 mm without contacting intervening relatively lower topographical features.

2. The finishing tool of claim 1, wherein the major axis corresponds to a tool shaft.

3. The finishing tool of claim 1, wherein the one or more fibers are disposed circumferentially about one or more of a bottom surface and a side surface of the base.

4. The finishing tool of claim 1, wherein each of the one or more fibers has a length of greater than about 5 mm and a cross-sectional diameter or thickness along its length of greater than about 100 microns.

5. The finishing tool of claim 1, wherein each of the one or more fibers has a varying cross-sectional diameter or thickness along its length.

6. The finishing tool of claim 1, wherein each of the one or more fibers has a varying cross-sectional shape along its length.

7. The finishing tool of claim 1, wherein each of the one or more fibers has a varying composition along its length.

8. The finishing tool of claim 1, wherein, in operation, the base portion and the end portion of each of the one or more fibers is coupled by a continuously curved intermediate portion.

9. The finishing tool of claim 1, further comprising a weighted structure coupled to an end of each of the one or more fibers, wherein the weighted structure has a diameter, thickness, or cross-sectional area that is greater than the diameter, thickness, or cross-sectional area of the associated fiber.

10. The finishing tool of claim 1, further comprising an abrasive disposed about the one or more fibers adjacent to the surface of the part.

11. A method for modifying a surface of a part, comprising:

providing a finishing tool, comprising:

a base, wherein the base is one or more of rotated and translated; and one or more fibers coupled to the base;

wherein a base portion of each of the one or more fibers is disposed at a first angle relative to a major axis of the base, wherein the first angle is equal to or between −90 degrees and 90 degrees;

wherein each of the one or more fibers has a sufficient flexibility such that, in operation, an end portion of each of the one or more fibers is disposed at a second angle relative to the major axis of the base, wherein the second angle is approximately −90 degrees or 90 degrees, substantially parallel to the surface of the part; and wherein each of the one or more fibers has a sufficient rigidity such that, when the end portion of each of the one or more fibers is disposed substantially parallel to the surface of the part in operation, the end portion of each of the one or more fibers removes only a relatively higher topographical feature of a Mid-Spatial Frequency (MSF) structure and is suspended above a relatively lower topographical feature of the MSF structure; and contacting the end portion of each of the one or more fibers with the relatively higher topographical feature of the MSF structure above the relatively lower topographical feature of the MSF structure;

wherein the end portion of each of the one or more fibers disposed substantially parallel to the surface of the part contacts a plurality of MSF structure apices over a distance of at least 5 mm without contacting intervening relatively lower topographical features.

12. The method of claim 11, wherein the major axis corresponds to a tool shaft.

13. The method of claim 11, wherein the one or more fibers are disposed circumferentially about one or more of a bottom surface and a side surface of the base.

14. The method of claim 11, wherein each of the one or more fibers has a length of greater than about 5 mm and a cross-sectional diameter or thickness along its length of greater than about 100 microns.

15. The method of claim 11, wherein each of the one or more fibers has a varying cross-sectional diameter or thickness along its length.

16. The method of claim 11, wherein each of the one or more fibers has a varying cross-sectional shape along its length.

17. The method of claim 11, wherein each of the one or more fibers has a varying composition along its length.

18. The method of claim 11, wherein, in operation, the base portion and the end portion of each of the one or more fibers is coupled by a continuously curved intermediate portion.

19. The method of claim 11, wherein the finishing tool further comprises a weighted structure coupled to an end of each of the one or more fibers, wherein the weighted structure has a diameter, thickness, or cross-sectional area that is greater than the diameter, thickness, or cross-sectional area of the associated fiber.

20. The method of claim 11, further comprising providing an abrasive disposed about the one or more fibers adjacent to the surface of the part.

21. A finishing tool for modifying a surface of a part, comprising:

a base, wherein the base is one or more of rotated and translated; and one or more fibers coupled to the base at both ends of each of the one or more fibers;

wherein, in operation with the base being rotated, a middle portion of each of the one or more fibers is disposed substantially parallel to the surface of the part;

wherein each of the one or more fibers is flexible but has a sufficient rigidity such that, when the middle portion of each of the one or more fibers is disposed substantially parallel to the surface of the part in operation with the base being rotated, the middle portion of each of the one or more fibers removes only a relatively higher topographical feature of a Mid-Spatial Frequency (MSF) structure and is suspended above a relatively lower topographical feature of the MSF structure; and wherein the middle portion of each of the one or more fibers disposed substantially parallel to the surface of the part contacts a plurality of MSF structure apices over a distance of at least 5 mm without contacting intervening relatively lower topographical features.

22. The finishing tool of claim 21, wherein, in operation with the base being rotated, each of the one or more fibers forms a continuously curved loop.

* * * * *